US006415467B1

(12) United States Patent
Bretvin

(10) Patent No.: US 6,415,467 B1
(45) Date of Patent: Jul. 9, 2002

(54) AIR CUSHION FOR PRESSURE RELIEF AND CONTROL

(76) Inventor: Gunnar Bretvin, Asaveien 22, Oslo, N-0362 (NO)

( * ) Notice: Subject to any disclaimer, the term of this patent is extended or adjusted under 35 U.S.C. 154(b) by 0 days.

(21) Appl. No.: 09/508,480

(22) PCT Filed: Sep. 10, 1998

(86) PCT No.: PCT/NO98/00273

§ 371 (c)(1),
(2), (4) Date: May 15, 2000

(87) PCT Pub. No.: WO99/13814

PCT Pub. Date: Mar. 25, 1999

(30) Foreign Application Priority Data

Sep. 12, 1997 (NO) ..... 974214

(51) Int. Cl.[7] ..... A47C 27/10
(52) U.S. Cl. ..... 5/710; 5/706; 5/713; 5/654

(58) Field of Search ..... 5/710, 706, 712, 5/713, 654

(56) References Cited

U.S. PATENT DOCUMENTS 4,662,012 A * 5/1987 Torbet ..... 5/453
4,698,864 A * 10/1987 Graebe ..... 5/441
5,638,565 A * 6/1997 Pekar ..... 5/710
5,727,270 A * 3/1998 Cope et al. ..... 5/710

* cited by examiner

*Primary Examiner*—Teri Pham Luu
(74) *Attorney, Agent, or Firm*—Woodling, Krost and Rust

(57) ABSTRACT

The invention concerns an air cushion for pressure relief and control. The cushion consists of a plurality of air-filled cells connected with one another through channels. The channels connect separate groups of cells with one another in a modular pattern. The cushion may be designed in many different sizes, e.g. in mattress size.

8 Claims, 16 Drawing Sheets

AIR CUSHION FOR PRESSURE RELIEF AND CONTROL

This application claims priority based on PCT/NO98/00273, filed Sep. 10, 1998, which in turn claims priority based on Norwegian Application 974214, filed Sep. 12, 1997.

The present invention concerns an air cushion for pressure relief and control, of the type which may be employed, e.g., in a wheelchair, on a (lorry) seat, etc., wherein the cushion consists of a plurality of air-filled cells connected with one another through channels. The invention also concerns the method for producing such a cushion.

Cushions which are filled with air are employed daily in the health sector in various situations associated with the need for pressure relief and pressure administration and control. The advantage of using air rather than mechanical springing is that air is particularly suited for equalizing the pressure by means of redistribution while mechanical springs and foam rubber will steadily increase the counterpressure by means of compression. A cushion structure consisting of a plurality of cells connected to channels improves the air circulation between the cells, with the result that there will be an equal counterpressure regardless of the shape of the compressed area. In this manner the risk of pressure-generated injuries is reduced, while at the same time healing of incurred injuries is improved due to the fact that fluid transport in the body will be facilitated.

An example of such a cushion is disclosed in U.S. Pat. No. 3,605,145. The publication describes a cushion for support of the human body, equipped with cylindrical cells. The cells are located over a bottom which imparts stability to the cushion. The bottom has grooves for pressure connection with the cells and may be divided into several chambers, where each chamber will be pressure-connected with a specific number of cells. The chambers are pressure-connected at the bottom by the cells being lifted from the bottom by means of rods placed in a specific pattern. The bottom is also equipped with a valve for filling with air. The method of manufacture of the cushion consists in dipping a plate with several cylindrical projecting bodies in liquid latex rubber 10 to 20 times, until the desired cell thickness is achieved. When the rubber has hardened the plate is removed. The bottom may be made by dipping a flexible, but non-elastic material (e.g. a textile material) in a substance in order to form an elastomeric covering.

U.S. Pat. Nos. 4,541,136 and 5,561,875 disclose present day versions of air cushions with cells. Both publications show cushions consisting of a bottom and cells pressure-connected with one another via channels located in a bottom member.

The above-mentioned known solutions have a relatively limited area of application as well as practical drawbacks. The cells have to be relatively high in order for the cushion to have the desired functions and for it to be soft. This results in the cushion becoming unstable with regard to laterally directed forces. The known cushions therefore function reasonably well if they have support on three of the sides, but not where there is only support on one side such as, e.g., in a car seat or in other forms of chair bottoms. The height of the known cushions also, e.g., makes getting in and out of a car seat more difficult. Finally, cells can easily collapse, thus causing the function of the cushion to deteriorate without this being noticed by the user.

In addition to this and due to the fact that the flat bottom does not offer any possibility for airing the region between the bottom and the seat, moisture is apt to accumulate under the cushion. Moreover, the bottom of the cushion is very soft and flexible, providing no support for a correct sitting position.

A further problem arises due to the fact that the cells and the bottom in known cushions are glued together, with the result that the joint cannot be exposed to temperatures which are too high. This means that it is not possible to clean (disinfect) a cushion in, e.g., an autoclave.

These and other disadvantages are solved by a pressure relief cushion of the type mention in the introduction, which is characterized in that the cushion consists of a top and bottom layer of air-filled cells, each of which projects in its own direction from a relatively level central layer, which contains the channel connections between the cells, which connection preferably connects separate groups of cells to one another in a modular pattern. The invention also comprises a method for producing a pressure relief cushion with air-filled cells which are pressure-connected with one another through channels, where a top layer is moulded of a soft, elastic plastic material, e.g. TPE, with cells opened at one end and with a preferably level bottom section at the cell's open side, that a bottom layer is further moulded in a similar manner of the same material, the two layers' bottom sections, which will form the cushion's central layer, being equipped with furrow-shaped grooves or channels for the formation of connections between the cells, that the two layers are then placed with their bottom sections against each other, pressed together and welded into one unit.

According to an alternative feature of this method, the central layer is moulded as a separate centre plate, the centre plate, which together with the top and bottom layers' central sections is to form the cushion's central layer, being equipped with furrow-shaped grooves or channels for the formation of connections between the cells and with openings for vertical passage of air, that the two layers are then placed with their bottom sections against the centre plate, and that the layers and the centre plate are pressed together and welded into one unit.

For the formation of separate groups of cells with a mutual channel connection, undesired channels may be shut off by inserting rod elements in channels which do not require to be used before the welding is carried out.

Further features of the invention are presented in the patent claims.

The cushion according to the invention has several advantages. The cushion's design permits airing of the region between the bottom and the seat of the cushion, thus avoiding the formation of moisture. Moreover, the central layer is sufficiently rigid to act as a positioning means, i.e. it gives the cushion stability while at the same time constituting a support for a correct sitting position.

Furthermore, the central layer can be adapted to different uses, such as, e.g., providing sufficient rigidity to enable the cushion to act as a positioning means, i.e. it gives the cushion the stability to be able to form a support for a correct sitting position as well as giving wheelchair users, e.g., a better support for an active wheelchair use than existing products described above without losing the pressure relief properties.

In a preferred example the cells are in the form of "supereggs", i.e. rotationally symmetrical, flattened, elliptical bodies. Cells which are arranged in this manner are strong, since each cell in the cushion supports its own structure. This enables the cushion to withstand high external pressure or preserve the structure at a lower pressure. Such a cushion will therefore have a lower height than the known cushions with the same properties. This results in the cushion according to the invention being much more stable than the known cushions with regard to lateral forces. It will be possible to extend the cushion's area of application particularly in combination with special features.

The cushion is further equipped with one or more valves for control of pressure. When used in connection with a vehicle, the vehicle's pressure system (together with a pressure reduction valve) may be employed to keep the cushion's desired pressure stable under different conditions. Compressed air combined with micropores in the cushion can offer the possibility of transporting air away by means of air vents and air circulation and will also increase the comfort of the user of the cushion. A similar solution may be adapted for hospital use where the same effect can be achieved with a separate air pump system where special solutions for air circulation are required.

The cushions' cells are collected in modules in a modular pattern, i.e. not all the cells are pressure-connected through channels, but a specific number of cells are pressure-connected, forming a module. This gives the cushion flexibility of use, with, e.g., the opportunity of setting different pressure values in the different modules.

The cushion should bring the counterpressure down to the lowest blood pressure in people, i.e. in the area around 90 mm Hg.

With regard to the cushion's method of manufacture, it also manifests several advantages compared to the known methods and results in specially advantageous characteristics in the cushion.

The cushions' layers can be made by vacuum forming, injection moulding or blow moulding.

In vacuum forming the starting point is a foil, possibly laminated and consisting of several layers, where each layer may have different properties such as, e.g. an outer layer with a soft surface which at the same time is resistant to moisture, chemicals (used, e.g., for cleaning) and oil, while being protected against UV radiation and ozone; a central layer which may be gas-tight while also being resistant to tearing and which also reinforces the laminate and an inner layer which braces the structure. The foil is employed to make a top layer and a bottom layer, each layer having cells which project from a preferably level bottom section. The bottom section contains furrow-shaped grooves or channels, for the formation of connections between the cells. The bottom section will form the central layer in the finished cushion. The top and bottom layers are placed with their bottom sections against each other, pressed together and welded into one unit.

In injection moulding the material which forms the top and bottom layers will be an elastic alloy such as, e.g., Dupont's Alcryn, Nolato 500, Nolato 600, etc. which have the required properties. Injection moulding will preferably be performed at over 200° C. at 500 tons' pressure. The injection moulded layers are mounted in the same way as described above in connection with vacuum pressed parts.

In an alternative embodiment the top and bottom layers will be mounted and welded against a centre plate of a foil in which the channels and openings have been stamped out. The valves for external control are also mounted in grooves in the centre plate. It is advantageous for the centre plate to be made of a material with a somewhat higher melting point than the top and bottom layers (e.g. 200° C.), e.g. polypropylene. In this manner standard top and bottom layers can be used while simultaneously varying the channels, e.g. depending on the size of the cushions'. During welding a certain amount of overflow of material will occur and since the centre plate can withstand a higher melting point, clogging of the channels will be avoided. The vacuum forming and the welding can be performed in a simple operation while the material is still hot. This provides better control of overflow as well as a more rational production.

The use of a separate centre plate in the manufacture of the cushion has several advantages. The mounting and welding operations are considerably simplified, and the operation can be automated. At the same time, as mentioned above, the manufacture of the channels is simplified. In addition, this solution offers the possibility of controlling air transport between the top and bottom plates (vertical air transport), thus further increasing the cushion's stability. The centre plate's characteristics (rigidity, flexibility) can be controlled in order to adapt the cushion to different applications.

Both layers may be of the same or different thickness, the cells in each layer may be of different thicknesses, and even an individual cell may, if so desired, have different thicknesses in the height direction. The top and bottom layers may advantageously be identical, thereby simplifying production.

The module structure permits the definition of areas in the cushion which may have the same or different pressures.

In a preferred embodiment the cushion may be equipped with a heating layer by, e.g., inserting an electrically conductive foil whose heat generation can be controlled. The central layer may be made of an electrically conductive foil. In order to achieve the desired modular division according to a specific modular pattern, i.e. not all cells in the cushion have channel connection with one another, but the channel connections are limited to cell groups, e.g. 3 and 3 or 4 and 4, as mentioned above, in those channel connections which have to be shut off, there are placed short rods, which will close these channels when welded together. The desired patterns of co-operating cells can thereby be provided by conceivable means.

The materials which are employed for production of the cushion are within the same group of materials, thus enabling the material to be re-used in a "superior" and controlled manner. In a possible embodiment materials of the thermoplastics type are employed.

The finished cushion comprises a welded joint, which can be exposed to high temperatures, thus enabling the cushion to be disinfected by means of heat.

A cushion made in this way will have many applications, the application which formed the basis for the invention being pressure relief for lorry seats. The possibility of disinfecting the cushion and of grouping the cells into modules permits it to be employed for the production of hospital mattresses, operation mattresses, back and seat cushions for use in wheelchairs, back and seat cushions for treatment of positional complaints together with varying the pressure between four chambers in the cushion systematically as an active therapy in the treatment of back complaints.

The characteristics of the cushion which enable it to moderate shocks and cause it to be stabilising, permit its use in the seats of machine operators where the seat will move during operation of the machine, or in seats which will move in order to moderate shocks during operation.

The invention will now be described in more detail by means of the attached drawings, in which.

Figure 5:
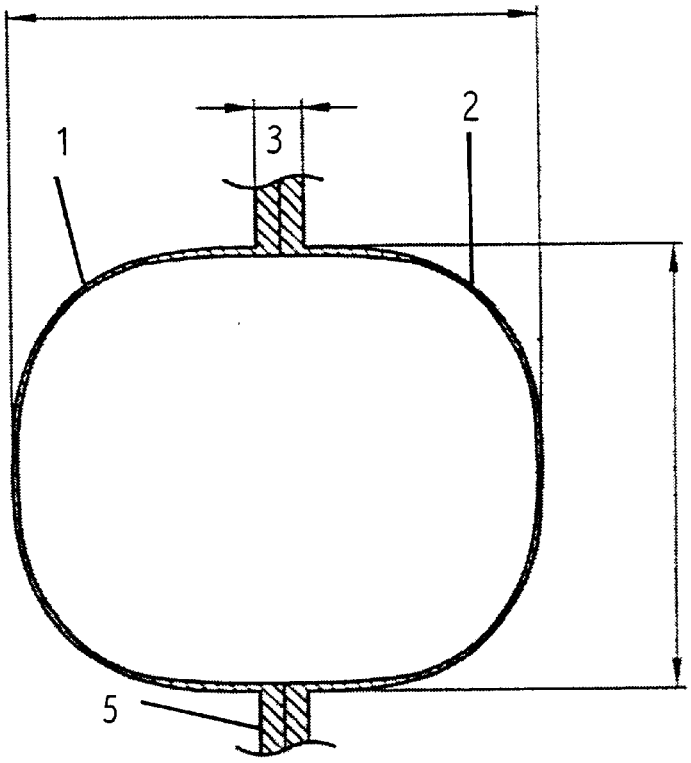
Figure 5:
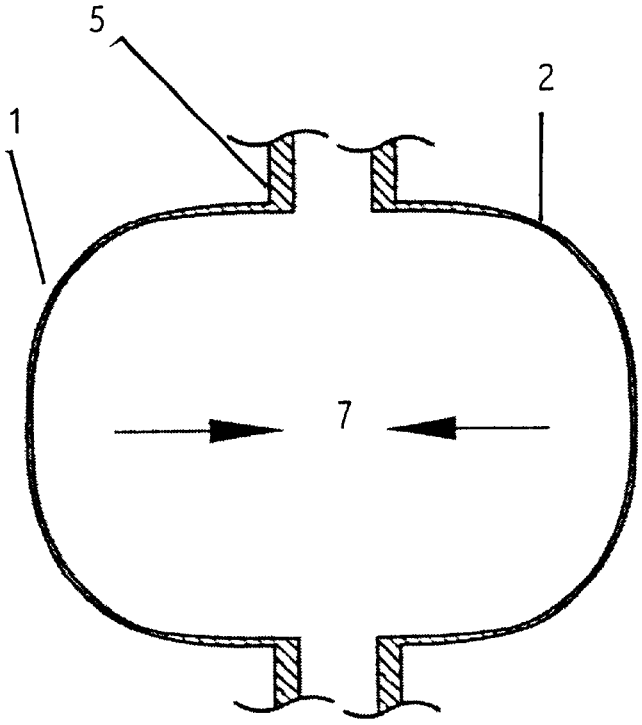
Figure 6:
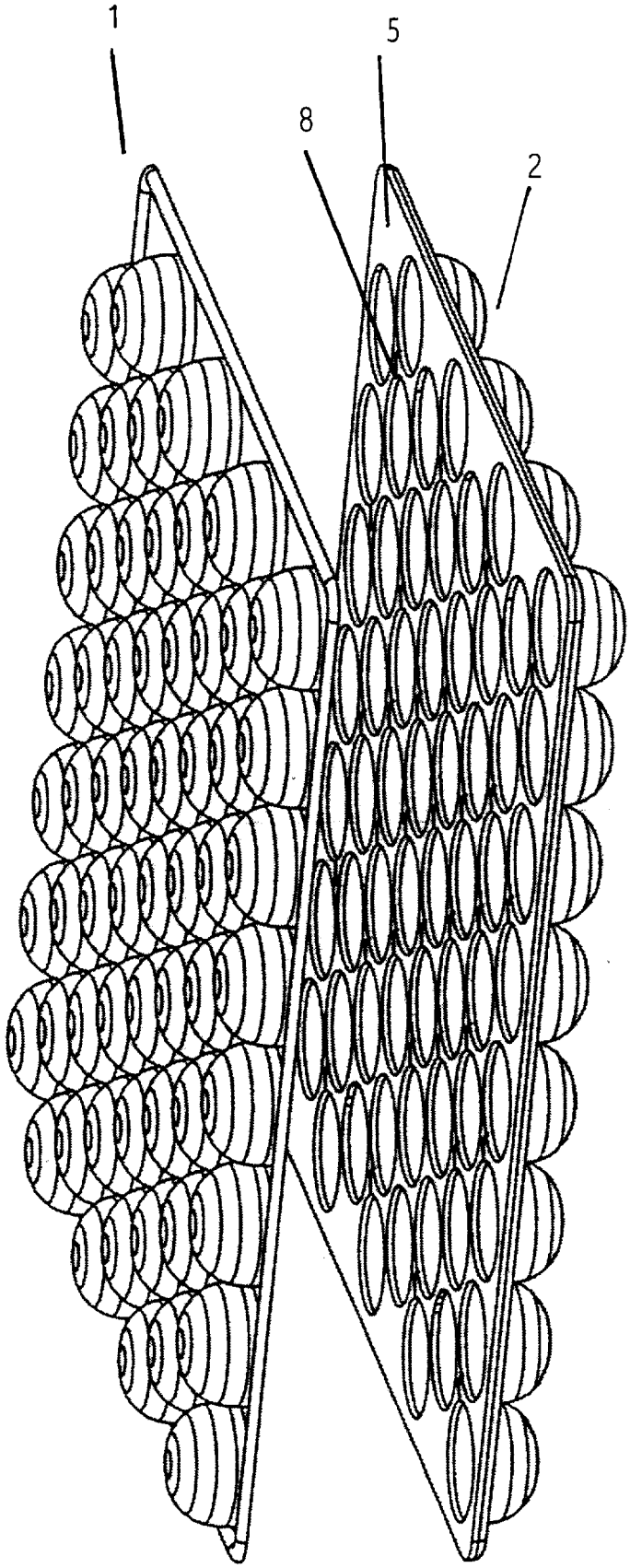
Figure 7:
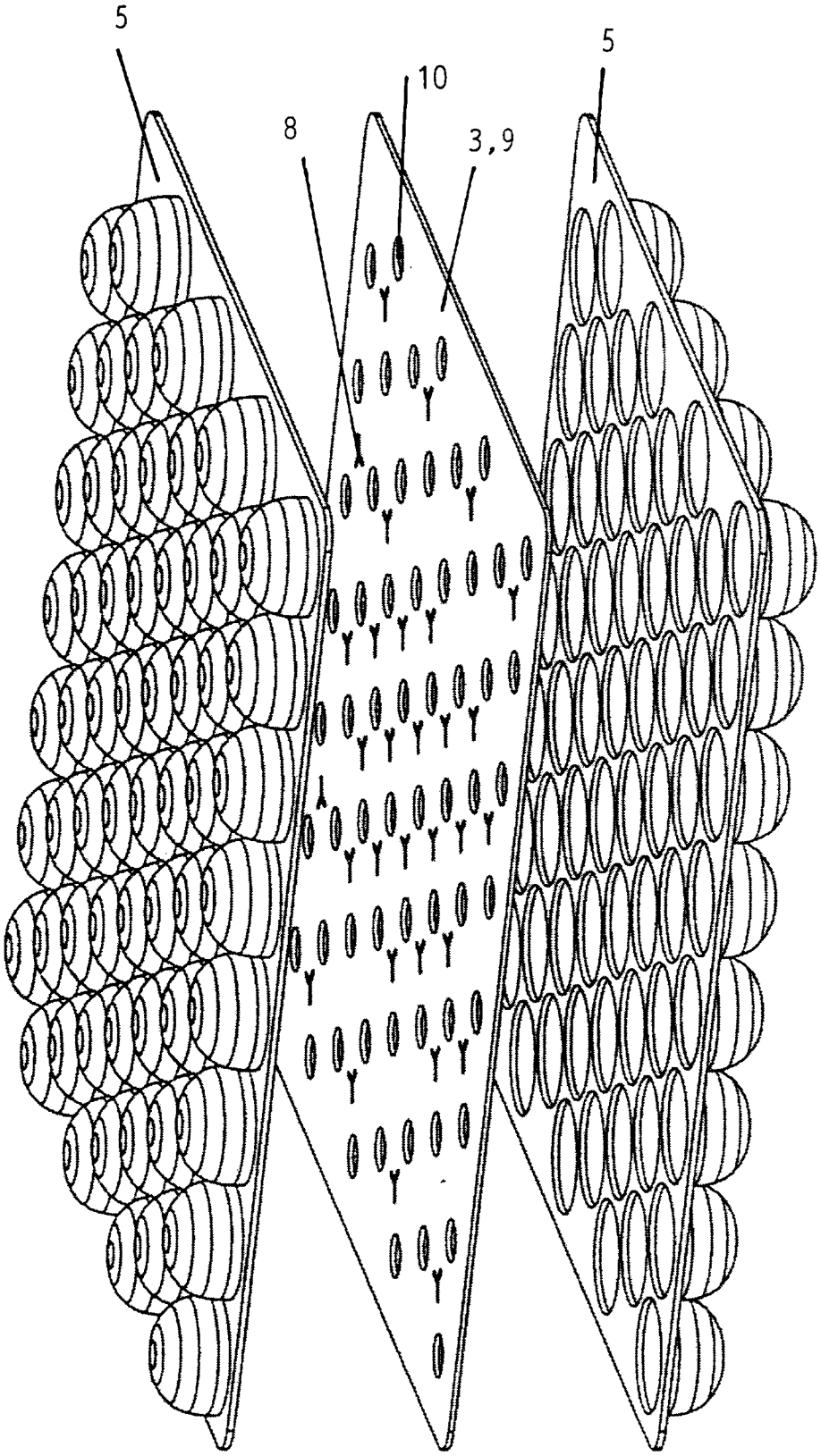
Figure 8:
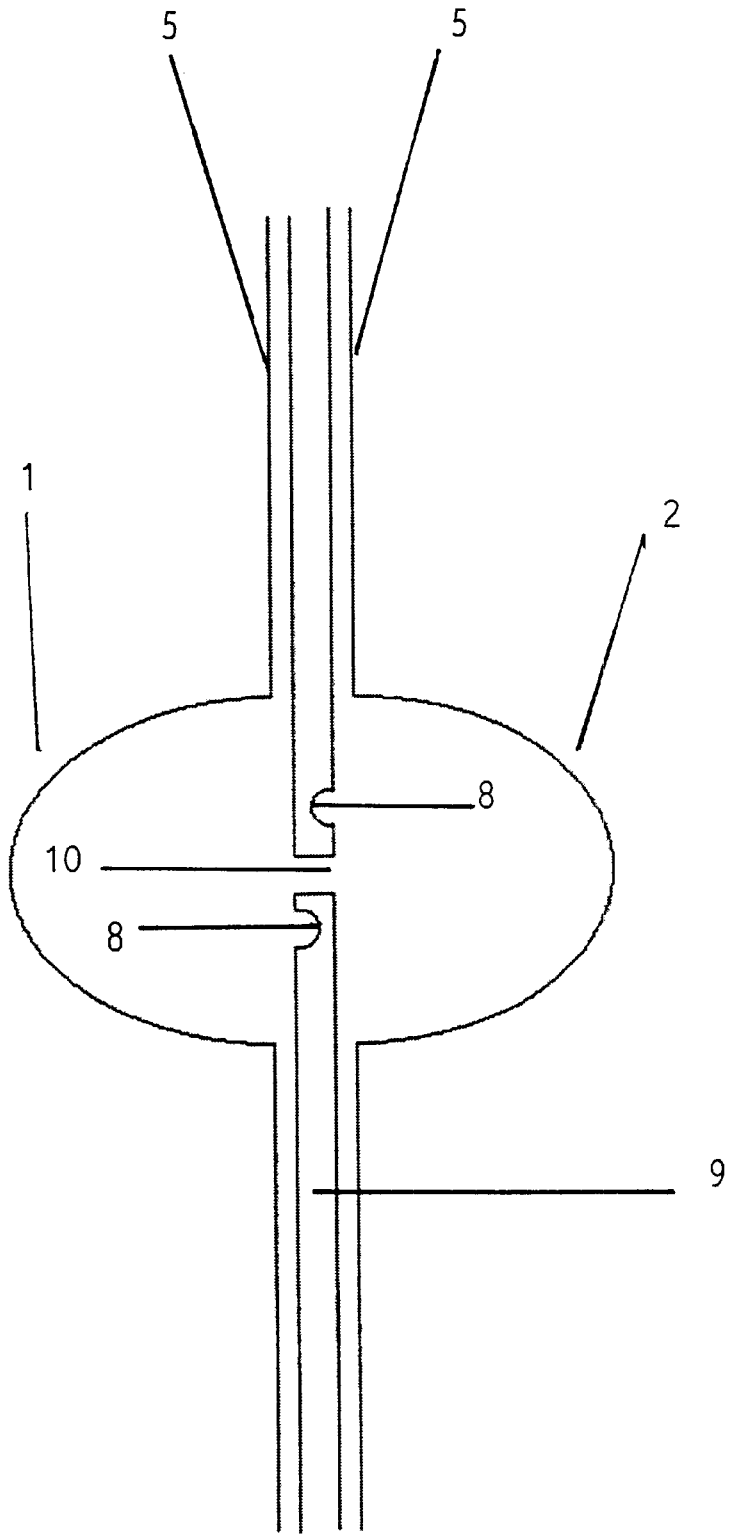
Figure 9:
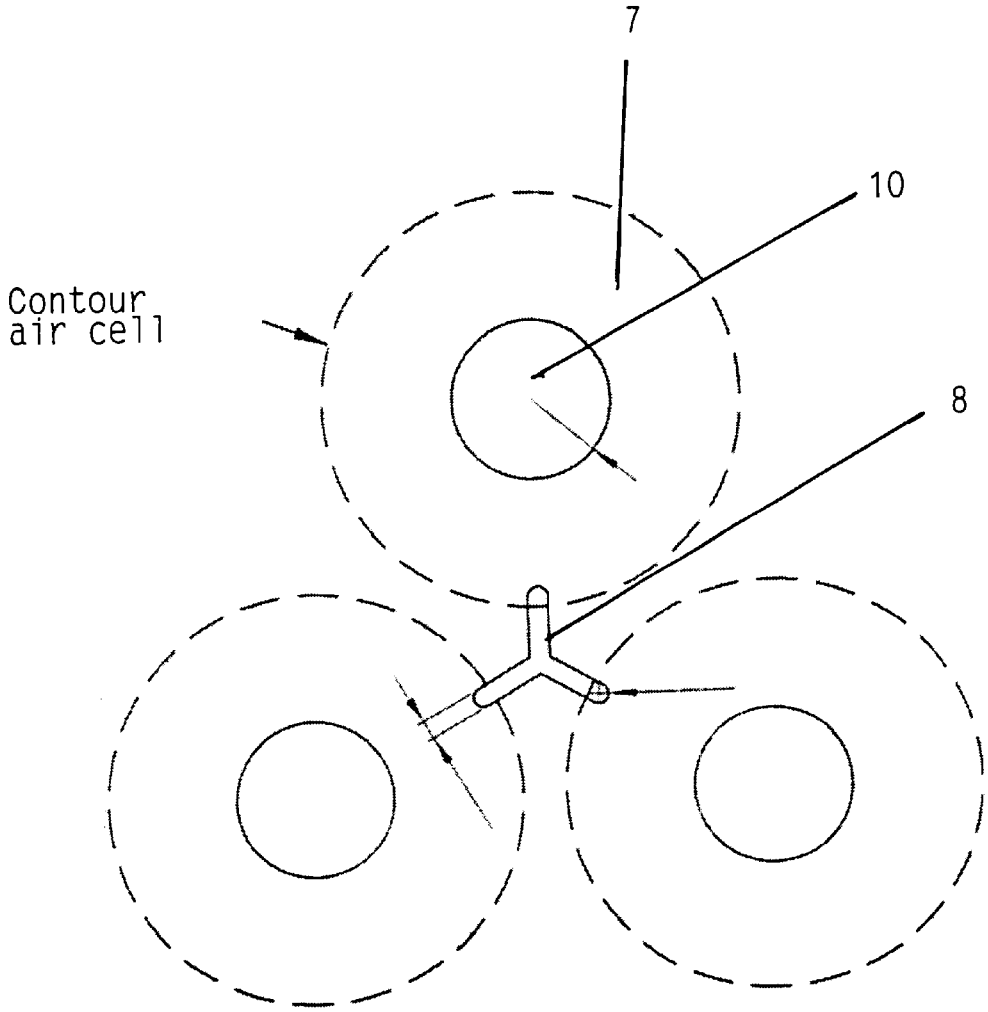
Figure 12:
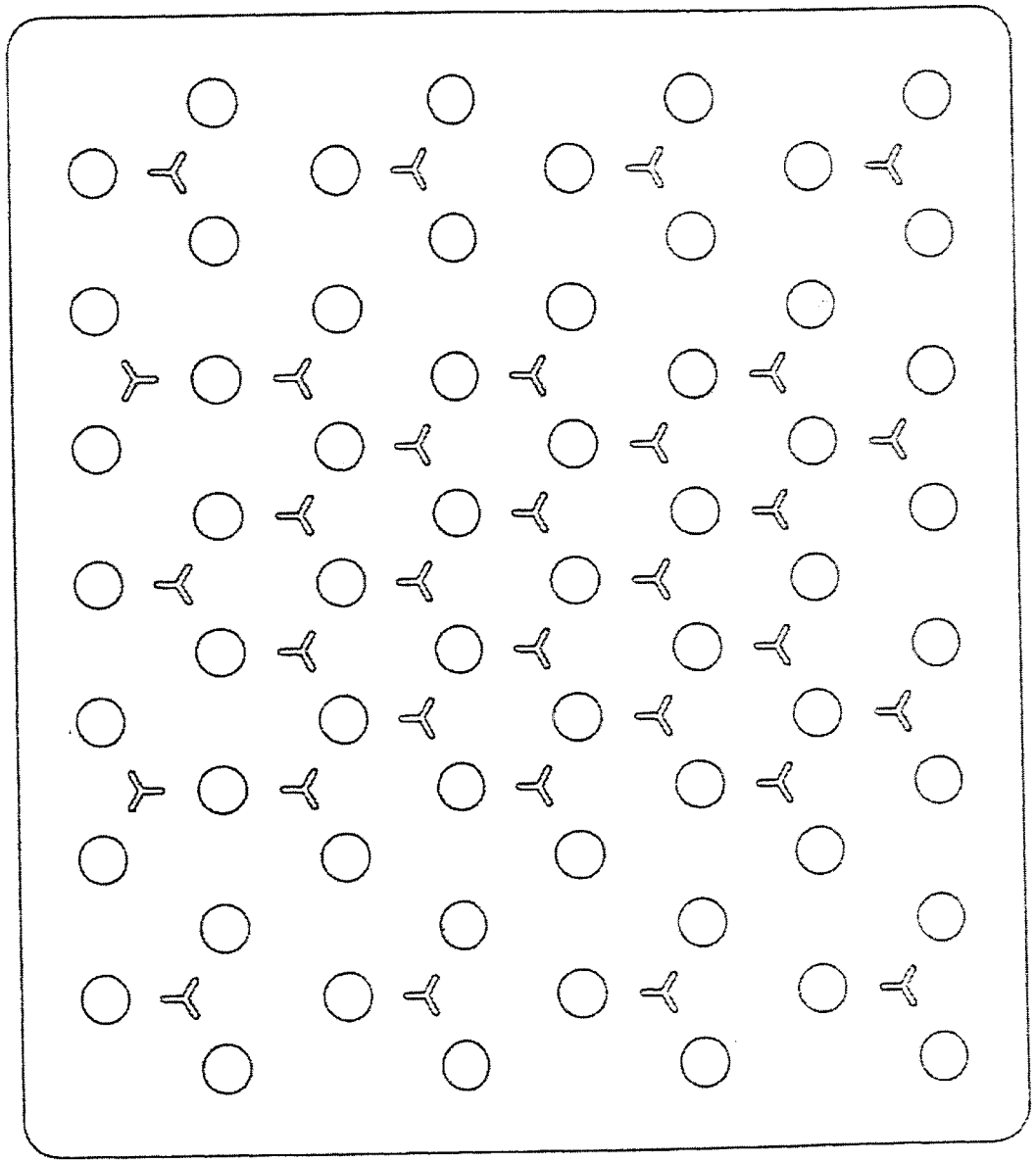
Figure 13:
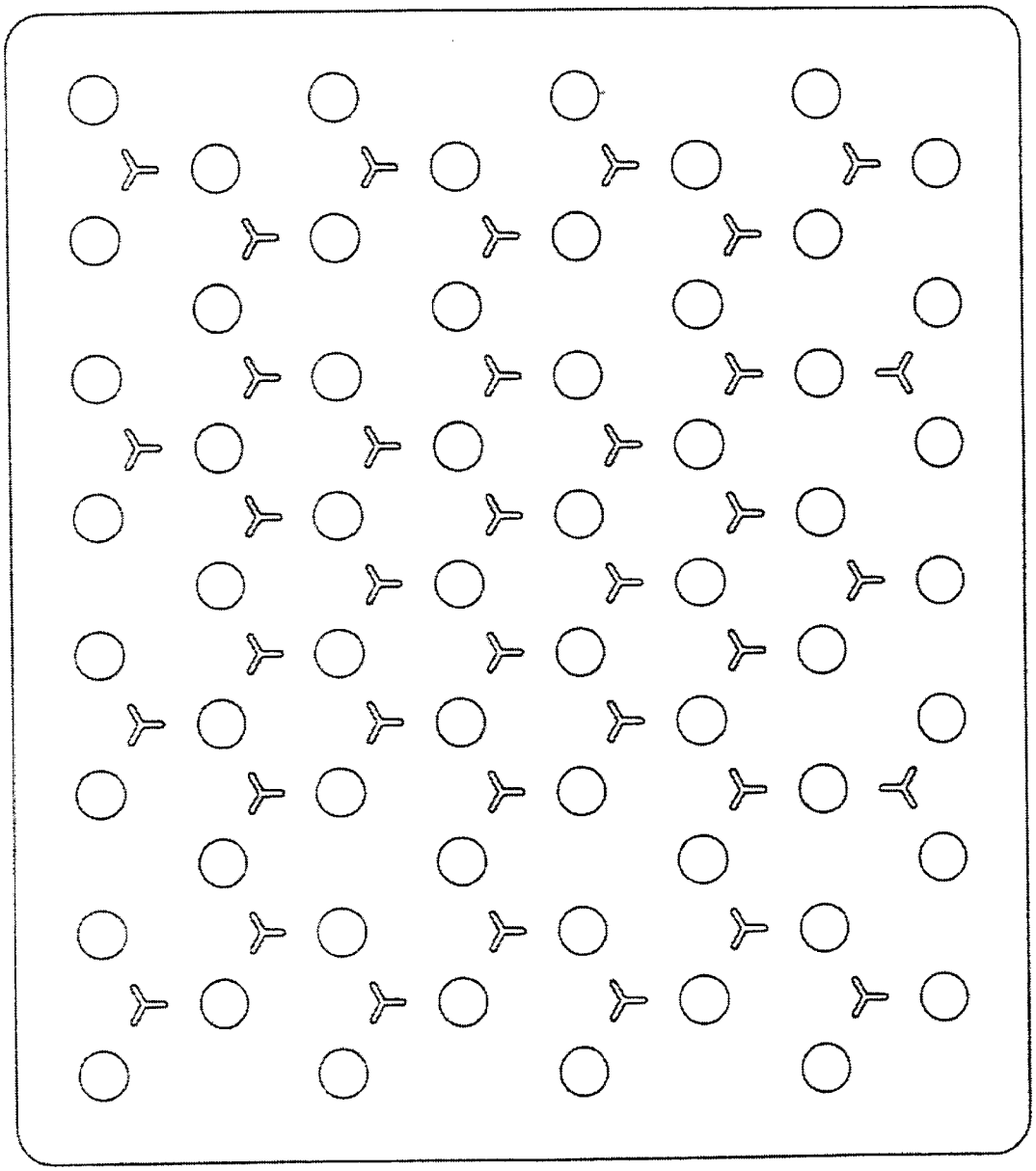
Figure 14:
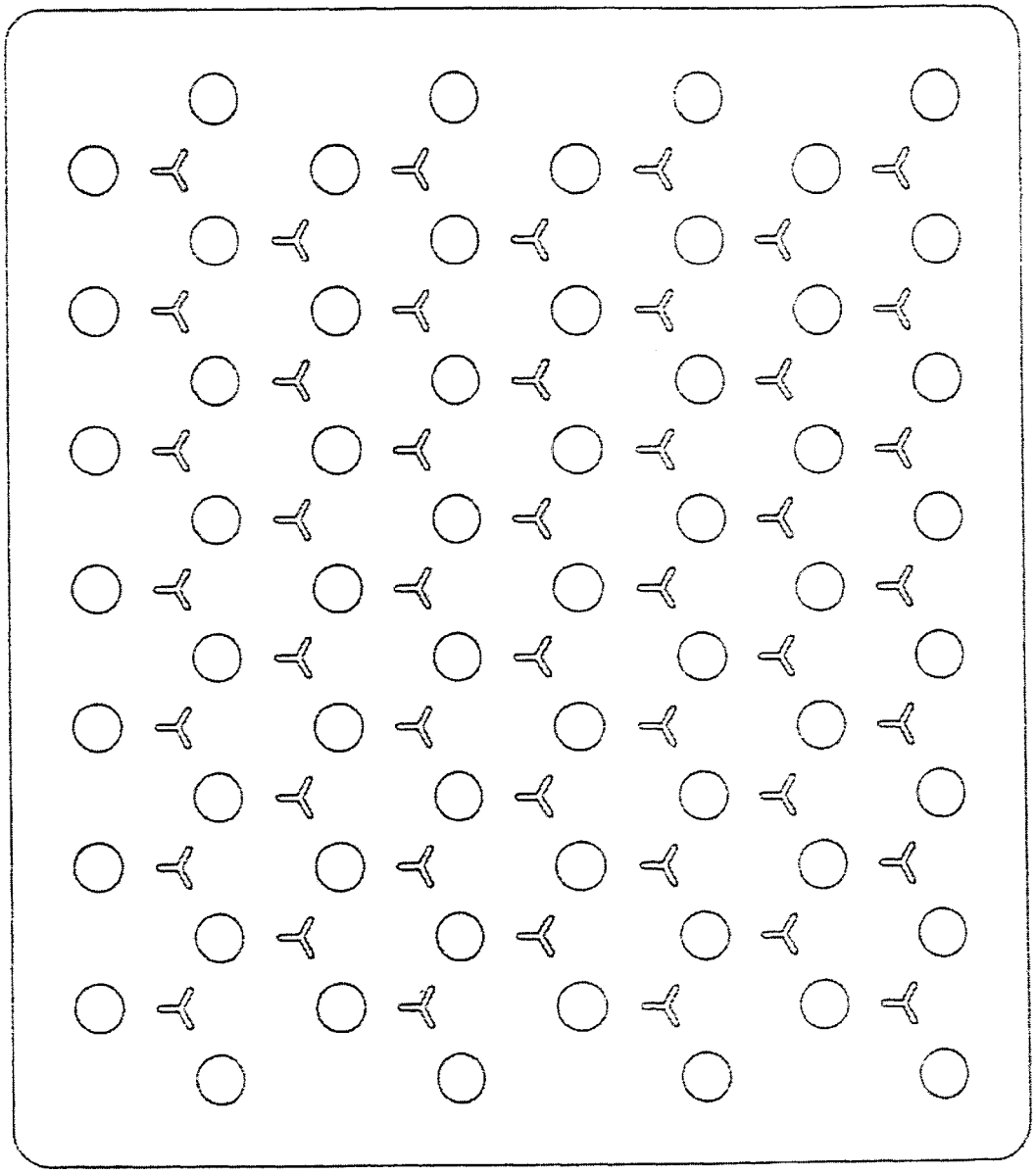

FIGS. 5 and 6 further illustrate the first embodiment of the cushion according to the invention;

FIGS. 7, 8 and 9 illustrate a second embodiment of the cushion according to the invention;

FIGS. 10A 10B, 11A and 11B illustrate possible positions for the valves in the cushion according to the invention;

FIGS. 12, 13 and 14 illustrate alternative modular patterns for the cushion according to the invention.

Figure 1:
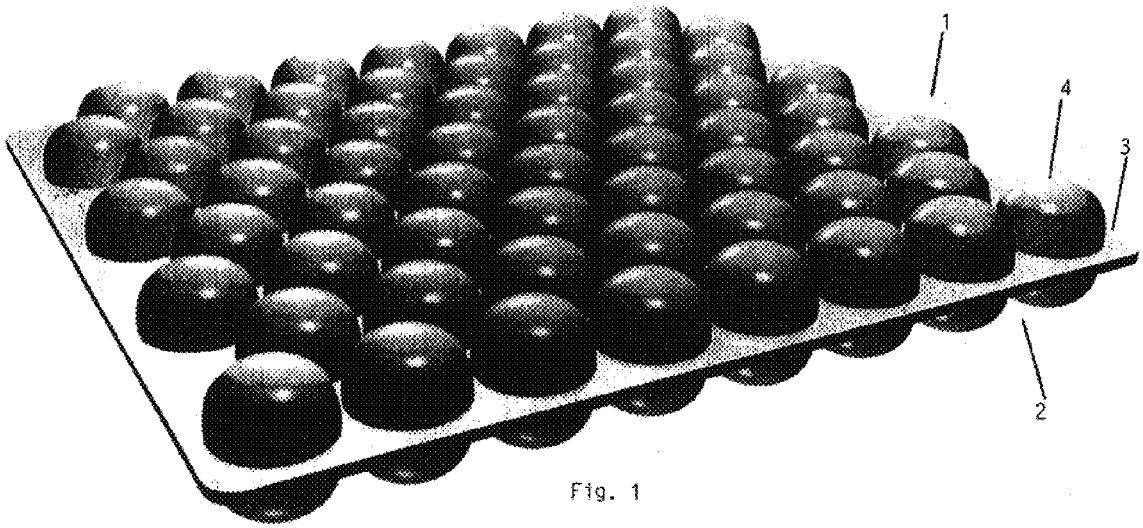
FIG. 1 is a veiw of the cushion according to the invention.

FIG. 1 is a view of the cushion according to the invention. The cushion consists of a top layer 1, a bottom layer 2 with cells 4, and a central layer 3. The central layer 3 consists of the bottom sections 5 in the top and bottom layers and also, in a preferred embodiment, of a centre plate 10.

Figure 2:
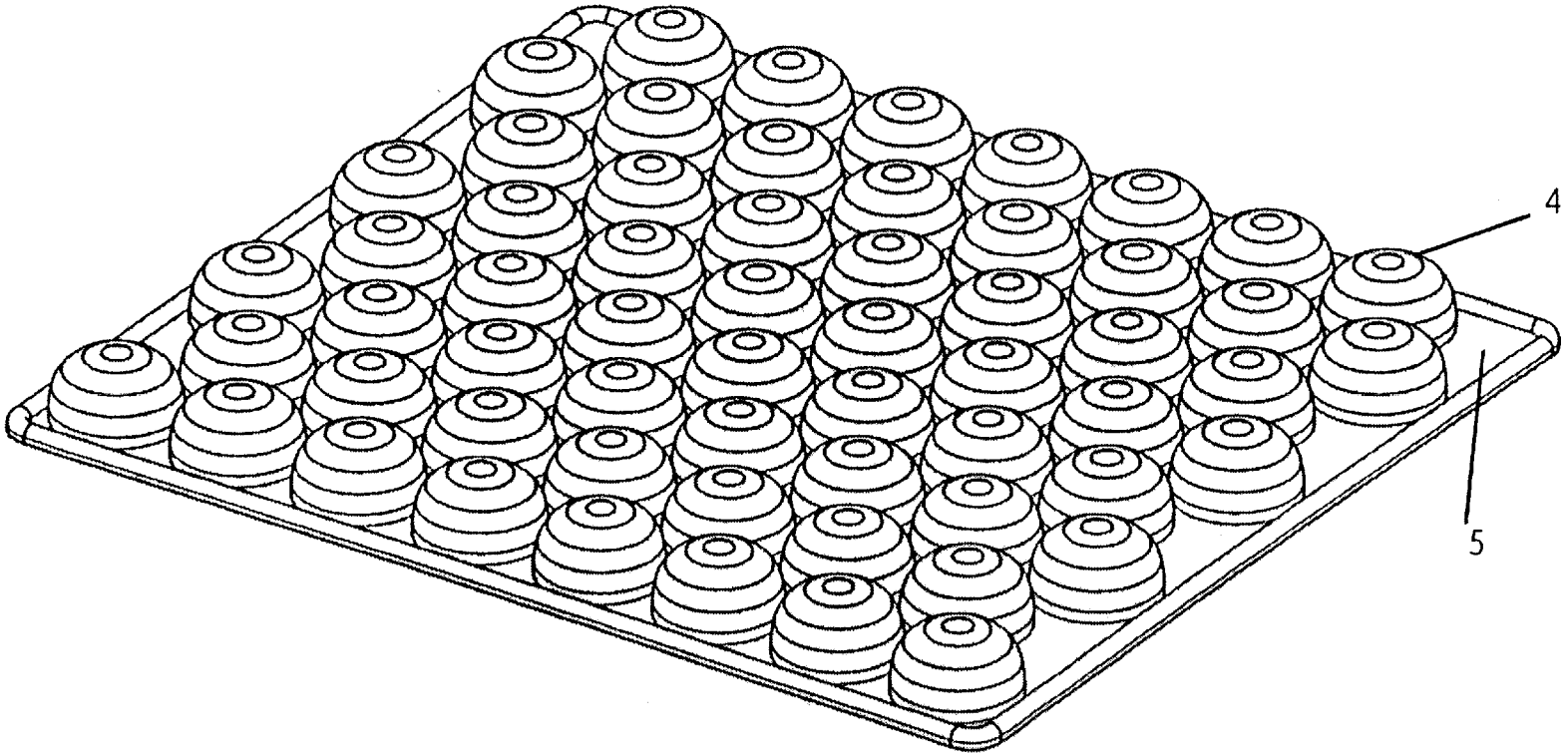
FIG. 2 illustrates a layer in greater detail.

FIG. 2 illustrates a layer in greater detail. The layer consists of cells 4 kept together by a bottom section 5. The cushion in the figure is provided with an edge round the cushion's periphery, which edge is not necessary in all embodiments of the invention and may be omitted.

Figure 3:
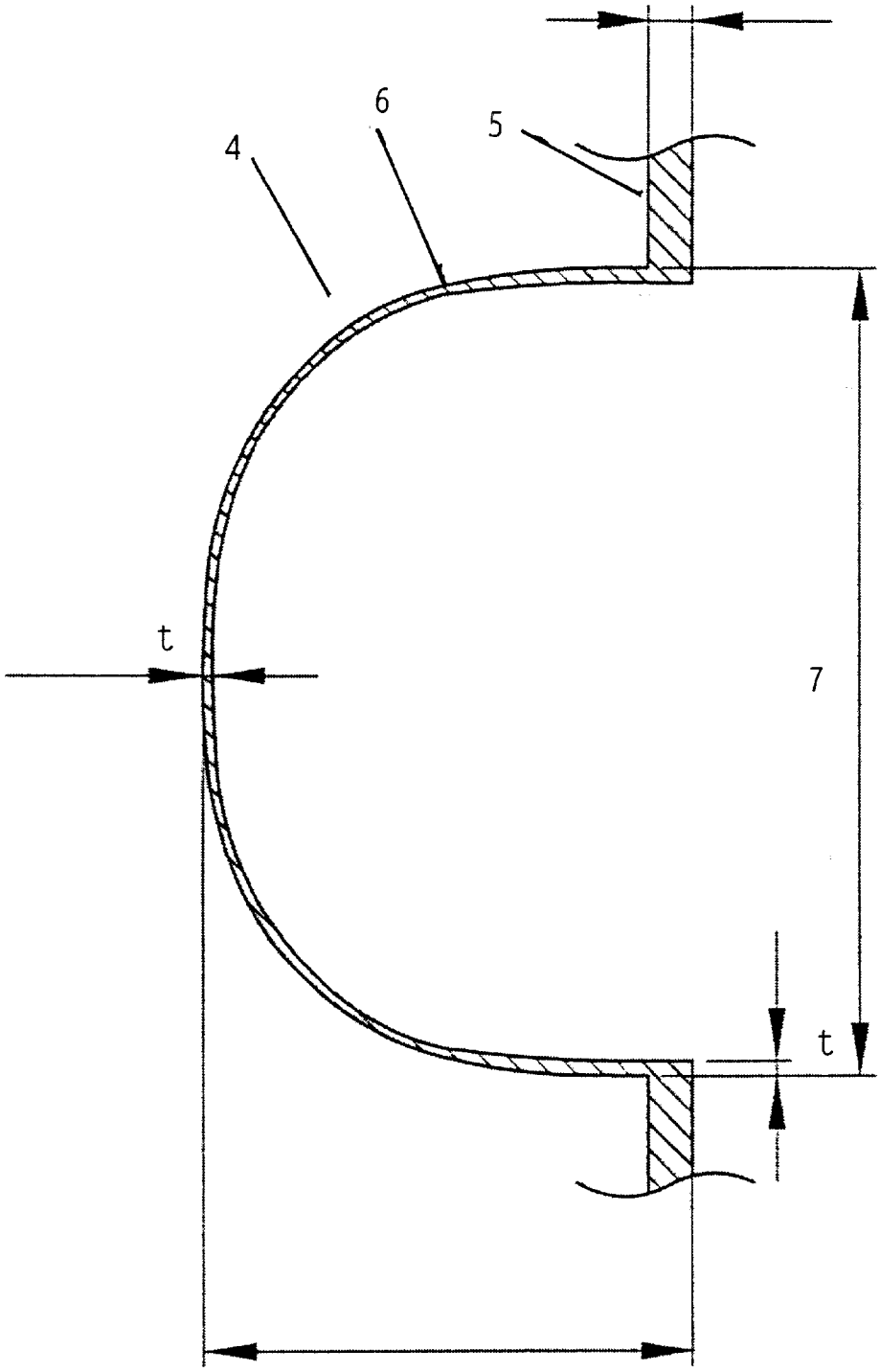
FIG. 3 is a view of a cell in the cushion according to the invention.

FIG. 3 illustrates a cell 4 designed according to a preferred embodiment as a rotationally elliptical body ("superegg"). The cell has walls 6 which in a preferred embodiment have a thickness t which varies in the height direction. The cell has an opening 7 for pressure connection with a corresponding cell located in the other layer. The size of the opening may vary during production of the top and bottom layers in order to control the rate of pressure equalization.

Figure 4:
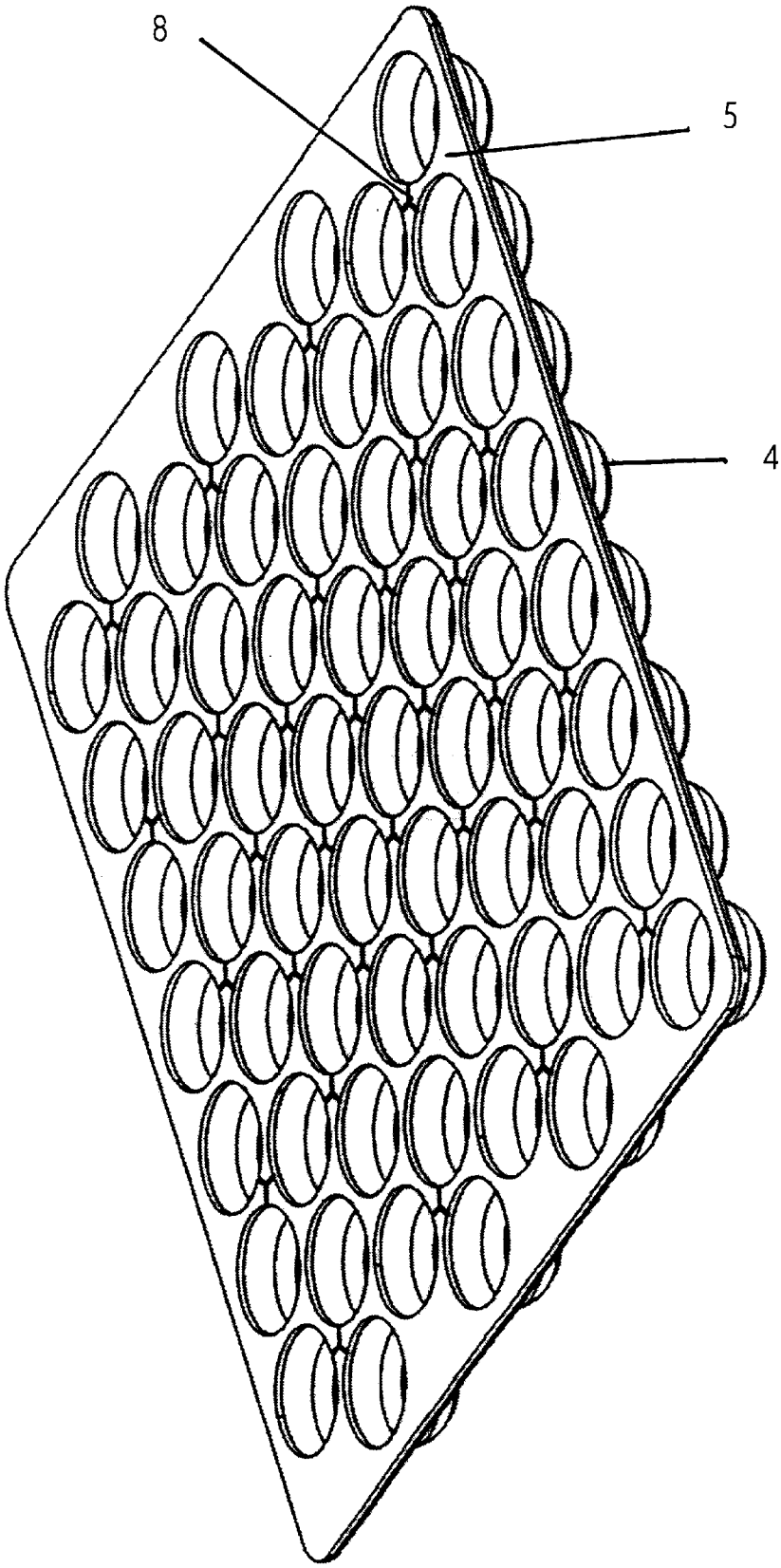
FIG. 4 illustrates a first embodiment of the cushion according to the invention.

FIG. 4 illustrates a first embodiment of the cushion according to the invention, where the channels 8 which pressure-connect the cells 4 and which form the modular pattern are arranged in the bottom section 5.

FIG. 5 illustrates the manufacture of the said first embodiment of the cushion, where the top and bottom layers 1 and 2 respectively are mounted and welded together. In this embodiment the cells are open in the whole cross section 7.

FIG. 6 also illustrates the manufacture of the first embodiment of the cushion, with channels 8 through the cells for pressure connection and formation of the modular pattern.

FIGS. 7, 8 and 9 illustrate a second embodiment of the cushion according to the invention. In this embodiment the cushion's central layer 3 consists of a centre plate 9 arranged centrally and of the bottom sections 5 in the top layer 1 and the bottom layer 2. The centre plate 9 has stamped-out channels 8 for pressure connection and formation of the modular pattern and openings 10 for vertical passage of air between the cells 4 in the top and bottom layers 1 and 2 respectively. The openings 10 in the centre plate, together with the openings 7 in the cells, will control the passage of air through the cells and thereby the pressure equalization rate in the cushion. The openings 10 in the centre plate and in the cells 7 may be of the same or different sizes.

Figure 10A:
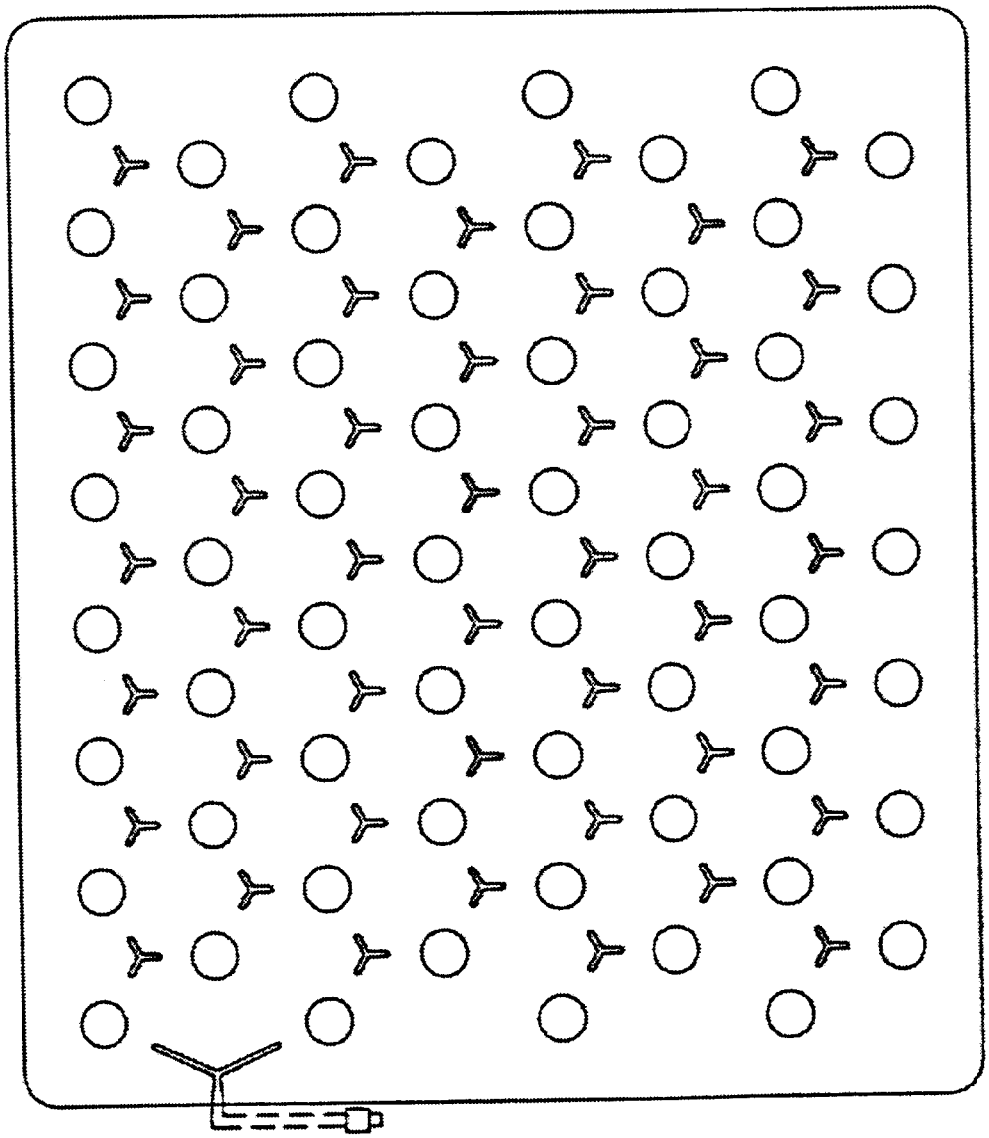
Figure 10B:
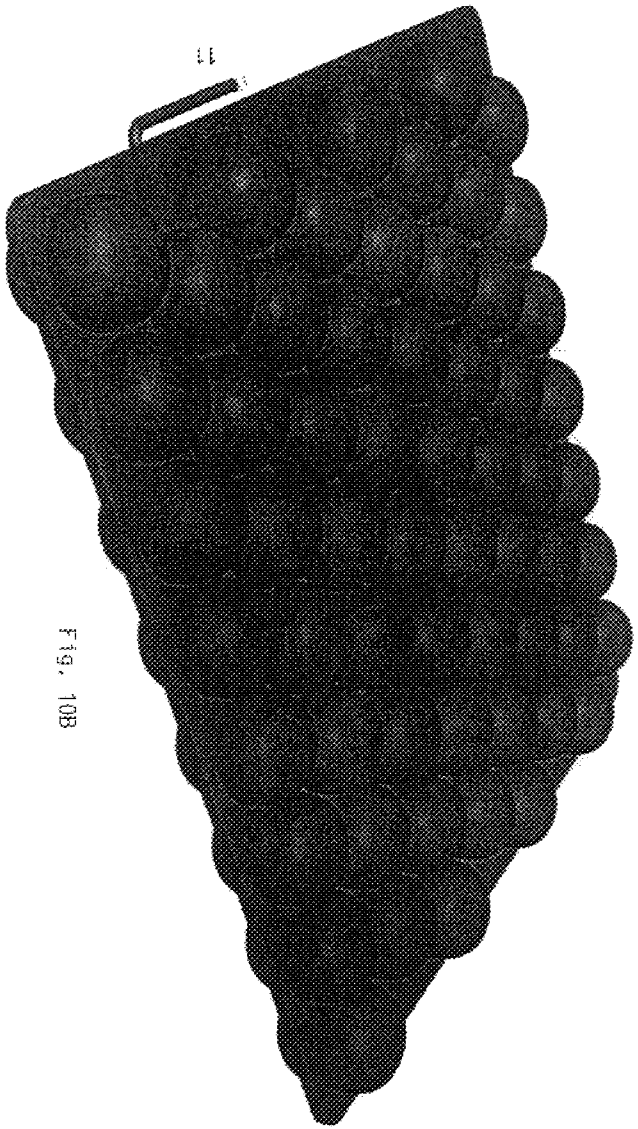

FIGS. 10A and 10B illustrate an embodiment of the invention in which all cells are pressure-connected to one another. In this embodiment the cushion is equipped with a single valve 11 for filling with air.

Figure 11A:
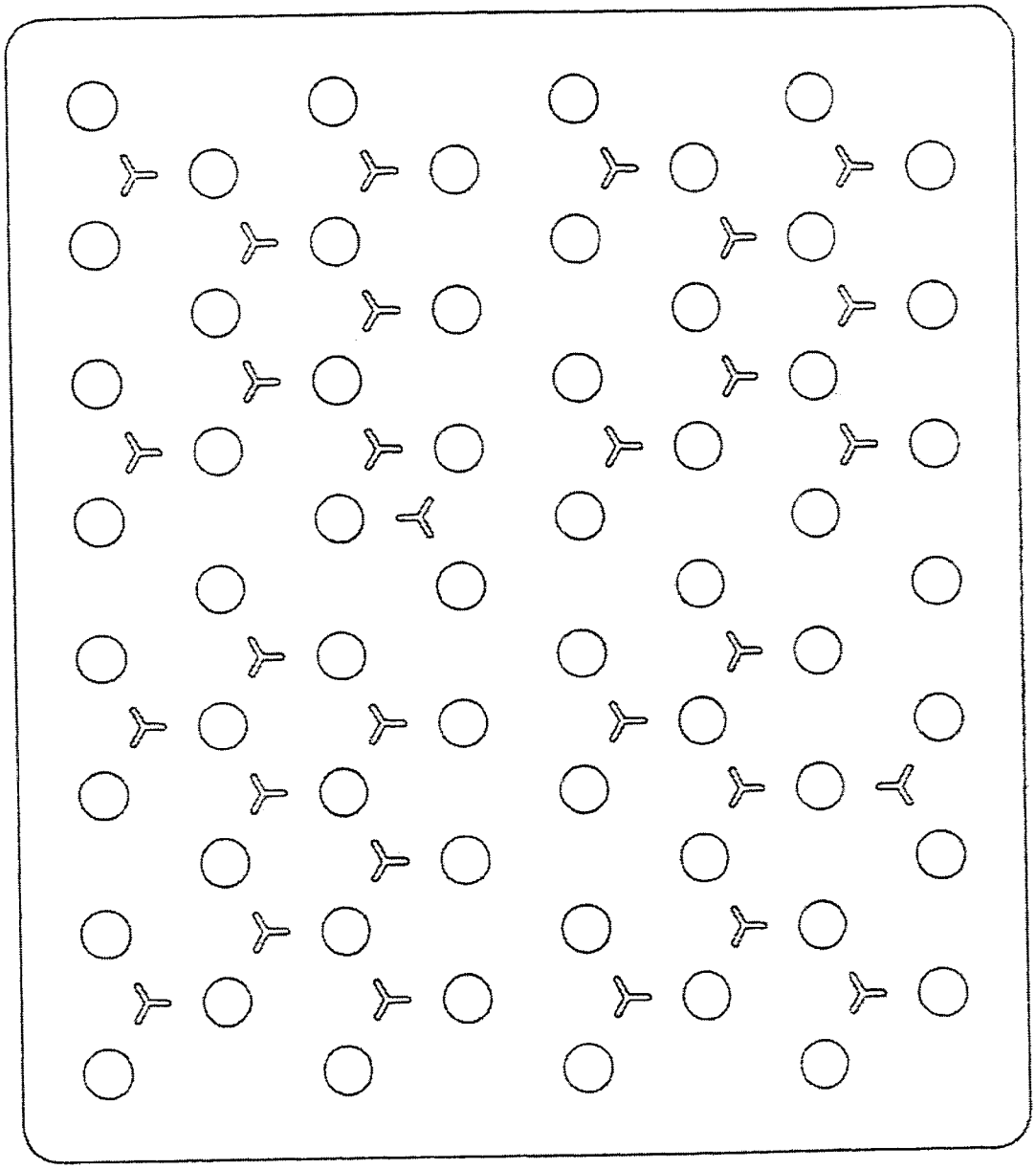
Figure 11B:
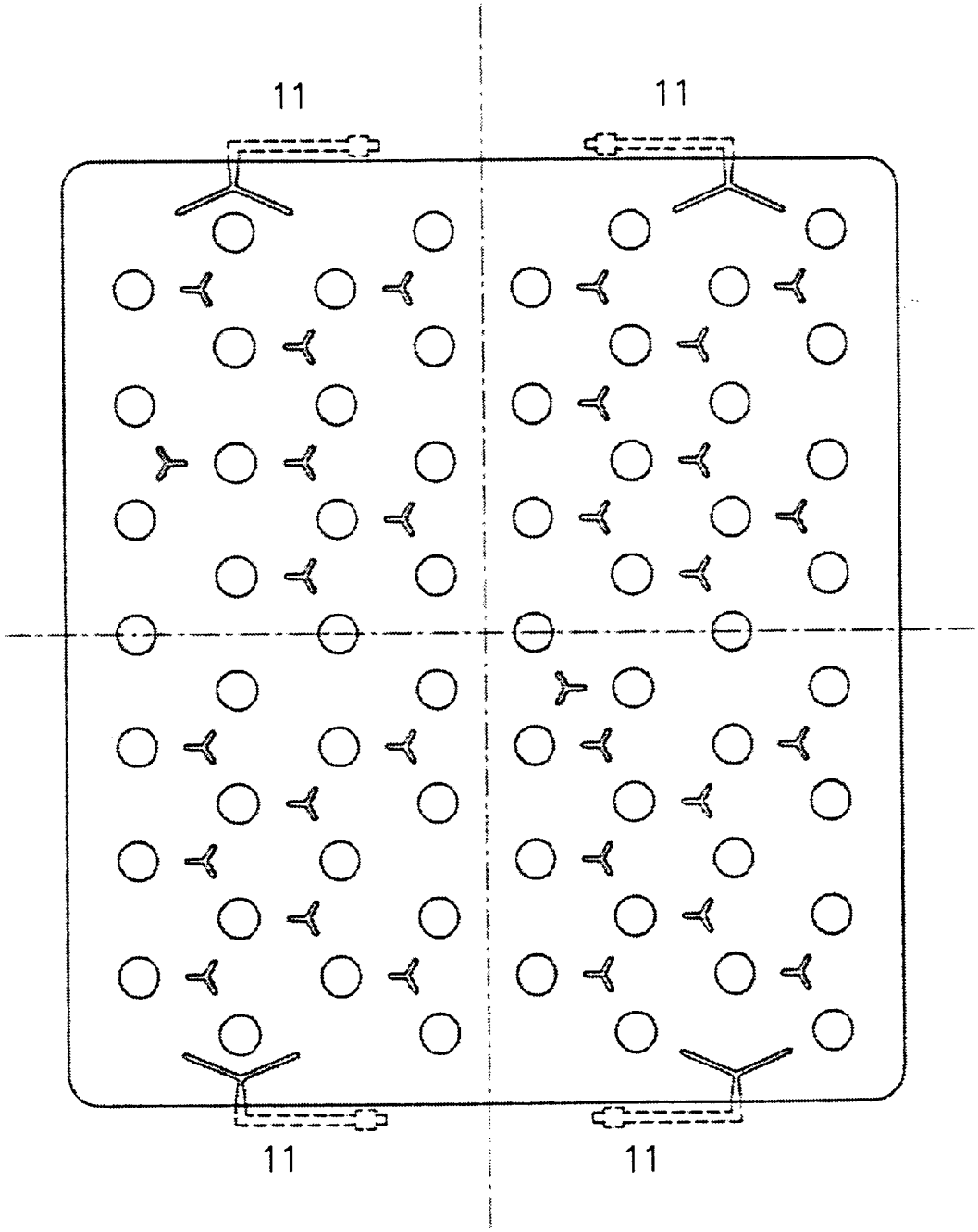

FIGS. 11A and 11B illustrate an embodiment of the invention in which the cells are divided into four groups which are supplied with air by four valves.

FIGS. 12, 13 and 14 illustrate other embodiments of the cushion according to the invention, where the cells are grouped according to different modular patterns. The modular pattern is adapted to the cushion's application.

The pressure relief cushion will be able to be used in many areas of application and adapted to special applications by integrating special features in the cushion, for example for adapting it to a wheelchair (with a view, e.g., to simplifying and securing the cushion's attachment to the chair). The cushion may also be designed in many different sizes, e.g. in mattress size.

What is claimed is:

1. A pressure relief cushion, consisting of air-filled cells (4) connected with one another through channels (8), characterized in that the cushion consists of a top layer (1) and a bottom layer (2) of air-filled cells (4), each of which projects in its own direction from a preferably level central layer (3), which contains the channel connections (8) between the cells, which connections preferably connect separate groups of cells with one another in a modular pattern.

2. A pressure relief cushion according to claim 1, characterized in that the air-filled cells (4) have elliptical, preferably superelliptical cross sections, whose size decreases towards the tops of the cells (4).

3. A pressure relief cushion according to claim 1, characterized in that the cells have walls (6), whose thickness (t) varies in the cells' height direction.

4. A pressure relief cushion according to claim 1, characterized in that the modules are mutually pressure-independent, and may have different internal pressures.

5. A pressure relief cushion according to claim 1, characterized in that the modules are pressure-connected to one another.

6. A pressure relief cushion according to claim 1, characterized in that it is equipped with a valve for filling with air, or for pressure-control of the cells (4), with the possibility of being able to connect the cushion to the pressure system of a vehicle for filling with air and/or pressure-control.

7. A pressure relief cushion according to claim 1, characterized in that it is connected to a source of compressed air.

8. A pressure relief cushion according to claim 7, characterized in that it is made of a material with micropores, e.g. TPE.

* * * * *